US012102884B1

(12) United States Patent
Jiang

(10) Patent No.: US 12,102,884 B1
(45) Date of Patent: Oct. 1, 2024

(54) BALANCE BEAM

(71) Applicant: Kaili Jiang, Kaili (CN)

(72) Inventor: Kaili Jiang, Kaili (CN)

( * ) Notice: Subject to any disclaimer, the term of this patent is extended or adjusted under 35 U.S.C. 154(b) by 0 days.

(21) Appl. No.: 18/434,331

(22) Filed: Feb. 6, 2024

(30) Foreign Application Priority Data

Jan. 31, 2024 (CN) ..... 202410137698.5

(51) Int. Cl.
*A63B 4/00* (2006.01)

(52) U.S. Cl.
CPC ..... *A63B 4/00* (2013.01); *A63B 2210/50* (2013.01); *A63B 2225/093* (2013.01)

(58) Field of Classification Search
CPC . A63B 4/00; A63B 21/00047; A63B 21/0005; A63B 21/00054; A63B 21/078; A63B 21/4027; A63B 21/4029; A63B 22/0046; A63B 26/00; A63B 26/003; A63B 71/0036; A63B 2210/00; A63B 2210/50; A63B 2225/09; A63B 2225/093
See application file for complete search history.

(56) References Cited

U.S. PATENT DOCUMENTS 3,404,884 A * 10/1968 Sorenson ..... A63B 4/00 254/8 R
3,510,129 A * 5/1970 Reuther ..... A63B 4/00 108/147.22
3,990,697 A * 11/1976 Reuther ..... A63B 4/00 482/34
4,143,602 A * 3/1979 Brunn ..... A47C 3/36 108/117
4,148,264 A * 4/1979 Caravias ..... A47B 3/00 108/69
4,365,801 A * 12/1982 Medina ..... A63B 4/00 434/247
5,037,086 A * 8/1991 Strand ..... A63B 4/00 248/560
5,069,447 A * 12/1991 Snyderman ..... A63B 21/078 482/133
5,082,259 A * 1/1992 Gonzalez ..... A63B 23/0355 482/142
5,232,426 A * 8/1993 Van Straaten ..... A63B 21/4029 482/130
5,325,794 A * 7/1994 Hontani ..... A47B 3/0911 108/115
5,637,059 A * 6/1997 Dalebout ..... A63B 21/4029 482/52
D907,144 S * 1/2021 Zhao ..... D21/690
(Continued)

*Primary Examiner* — Gary D Urbiel Goldner

(57) ABSTRACT

A balance beam includes a main body and two support components. The main body includes a middle part and two connection parts located on opposing sides of the main body. The two support components are respectively connected to the two connection parts. Each support component includes a connector, a supporter and an adjuster. The connector is connected to the main body and the connector is provided with multiple connection positions at intervals. A connection end of the supporter is rotatably connected to an end of the connector. The supporter rotates between a folding state and an open state, a free end of the supporter is configured to support on a support surface, a first end of the adjuster is rotatably connected to the supporter, and a second end of the adjuster is detachably connected to one of the multiple connection positions.

16 Claims, 7 Drawing Sheets

(56) References Cited

U.S. PATENT DOCUMENTS

| | | | | |
|---|---|---|---|---|
| 11,759,666 | B1 * | 9/2023 | Liu | A63B 4/00 482/34 |
| 2006/0122045 | A1 * | 6/2006 | Webber | A63B 21/4029 482/142 |
| 2008/0248937 | A1 * | 10/2008 | Stillwell | A63B 21/4029 482/145 |
| 2017/0216656 | A1 * | 8/2017 | Leipheimer | A63B 69/0057 |
| 2019/0240527 | A1 * | 8/2019 | Hsieh | A63B 21/4047 |
| 2020/0078627 | A1 * | 3/2020 | Landsman | A63B 4/00 |
| 2022/0176190 | A1 * | 6/2022 | Pena | A63B 22/0235 |
| 2022/0219037 | A1 * | 7/2022 | Ho | A63B 21/4029 |
| 2024/0017112 | A1 * | 1/2024 | Su | A63B 4/00 |

* cited by examiner

BALANCE BEAM

CROSS-REFERENCE TO RELATED APPLICATIONS

The application claims priority of Chinese patent application CN 2024101376985, filed on Jan. 31, 2024, which is incorporated herein by reference in its entireties.

TECHNICAL FIELD

The present disclosure relates to the technical field of exercise equipment technology, in particular, to a balance beam.

BACKGROUND

Balance beams are widely known pieces of exercise equipment most commonly used in connection with gymnastics, and can effectively trains people's balance, body coordination, and flexibility; it is particularly beneficial for adolescents and those in rehabilitation training.

However, existing balance beam products are often fixed for indoor or outdoor use and cannot be moved, greatly limiting their usability and convenience; while some balance beam products are detachable, but many of these products are inconvenient to install and have unstable structures; and there are also foldable and height-adjustable balance beams, such balance beams typically feature multiple connection holes in supporting legs to allow for height adjustment, however, due to the multiple connection holes, the strength of the supporting legs is significantly reduced, making the beam prone to bending or breaking during use, which can affect user safety and cause great inconvenience.

To address these issues, the present disclosure provides a balance beam that effectively solves problems mentioned above with a simple structure, case of use, and durability.

SUMMARY

In order to overcome the shortcomings of the prior art, the present disclosure provides a balance beam which has a simple structure, case of use, and durability.

The technical solution adopted by the present disclosure to solve the technical problem is as follows.

The present disclosure provides a balance beam, including:

- a main body includes a middle part and two connection parts located on both sides;
- two support components, each of the two support components is connected to the respective connection parts;
- the support component includes a connector, a supporter, and an adjuster, the connector is connected to the main body and the connector is provided with multiple connection positions at intervals, a connection end of the supporter is rotatably connected to an end of the connector, the supporter rotates between a folding state and an open state, a free end of the supporter is configured to support on a support surface, a first end of the adjuster is rotatably connected to the supporter, and a second end of the adjuster is detachably connected to the connection position.

As the improvement of the present disclosure, the balance beam further includes a first pivot, the connector includes a first connection plate and two second connection plates, the first connection plate is connected to a bottom surface of the main body, and the two second connection plates extend from both side edges of the first connection plate in a direction away from the main body, a side of the two second connection plates near the middle part is provided with a first pivot hole, an end of the supporter is provided with a second pivot hole, and the first pivot passes through the first pivot hole and the second pivot hole, allowing the supporter to be rotatably connected to the connector.

As the improvement of the present disclosure, the supporter includes a first support plate and two second support plates, the two second support plates extend from both side edges of the first support plate towards the direction of the main body, the second pivot hole is arranged in the two second support plates, a distance between the two second support plates is less than a distance between the two second connection plates, and the second support plate is at least partially inserted between the two second connection plates.

As the improvement of the present disclosure, the balance beam further includes a second pivot, both middle parts of the two second support plates are provided with a third pivot hole, and an end of the adjuster is provided with a fourth pivot hole, and the second pivot passes through the third pivot hole and the fourth pivot hole, allowing the first end of the adjuster to be rotatably connected to the supporter.

As the improvement of the present disclosure, a width of the adjuster is smaller than a width between the two second support plates, and the adjuster is at least partially inserted between the two second support plates.

As the improvement of the present disclosure, the connection position is a elongated shape slot arranged on the second connection plate, the second end of the adjuster is provided with a contact rod which can be detachably inserted into the slot, such that a triangular support structure between the adjuster, at least a part of the connector, and a part of the supporter is formed.

As the improvement of the present disclosure, the slot is arranged at an incline, extending and inclining downwards from near the middle part in a direction away from the middle part.

As the improvement of the present disclosure, the contact rod is also provided with fasteners at both ends, the fasteners are threadedly connected to both ends of the contact rod, and twisting the fasteners adjusts a distance between the two fasteners, allowing the fasteners to abut against an outer surface of the second connection plate.

As the improvement of the present disclosure, the balance beam further includes a support rod arranged at the free end of the supporter, and extension direction of the support rod matches direction of the first pivot.

As the improvement of the present disclosure, further includes a protection cover fitted over both ends of the support rod.

As the improvement of the present disclosure, the free end of the supporter extends to both sides to form a mounting part, the mounting part is connected to the support rod, and a surface contour of the mounting part matches a surface contour of the support rod.

As the improvement of the present disclosure, when the supporter is rotated to the folding state, the second pivot is inserted into the slot located in a middle, and the contact rod is inserted into the slot located at an edge.

As the improvement of the present disclosure, the second support plate is provided with a receiving slot, when the supporter rotates to the folding state, the receiving slot corresponds to the slot, and the contact rod is inserted into the receiving slot.

As the improvement of the present disclosure, a length of the supporter is greater than a length of the second connection plate, when the supporter rotates to the folding state, the support rod is located on a side of the second connection plate that is external and away from the middle part.

As the improvement of the present disclosure, the fastener is provided with a plurality of protrusions at intervals along circumferential surface.

As the improvement of the present disclosure, an outer surface of the protection cover is provided with frictional patterns.

The present disclosure has the following beneficial effects. With the above structure, when in use, the supporter is rotated to be inclined relative to the main body, then rotate the adjuster and the second end the adjuster is connected to the connection position, thus a triangular support structure is formed between the connector, the supporter, and the adjuster, which can stably support the main body. The connection position is located on the connector, and the connector is located at a bottom of the connection part of the main body, a significant part of the force exerted on the connector is transferred to the main body, therefore shape and strength of the connector with the connection positions can be ensured, and the supporter and adjuster is provided with no connection holes, resulting in higher structural integrity, making the overall product more robust and durable, less prone to deformation, and more stable.

BRIEF DESCRIPTION OF THE DRAWINGS

FIG. 8 is a schematic view of the structure of the present disclosure in another open state.

DETAILED DESCRIPTION OF THE EMBODIMENTS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

Figure 1:
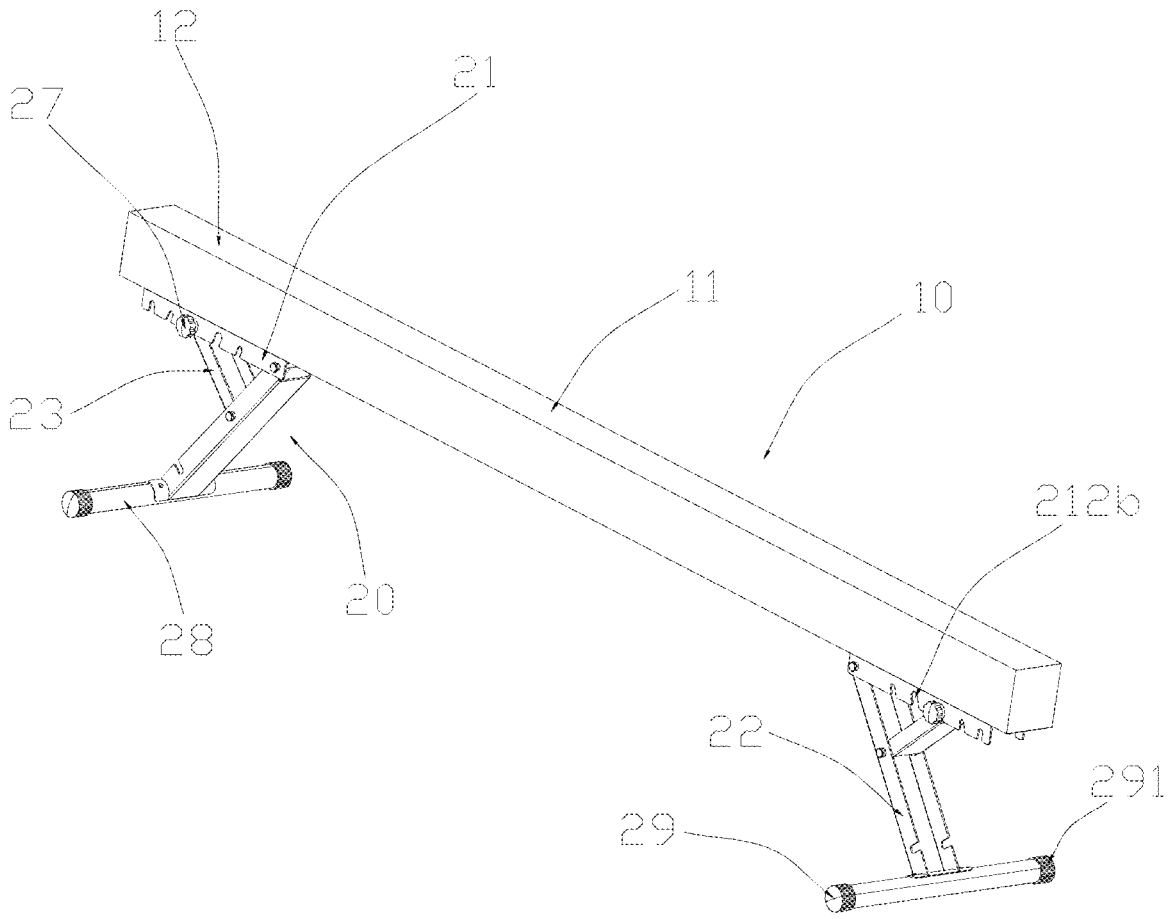
FIG. 1 is a schematic view of a structure of the present disclosure from one angle in an open state.
Figure 2:
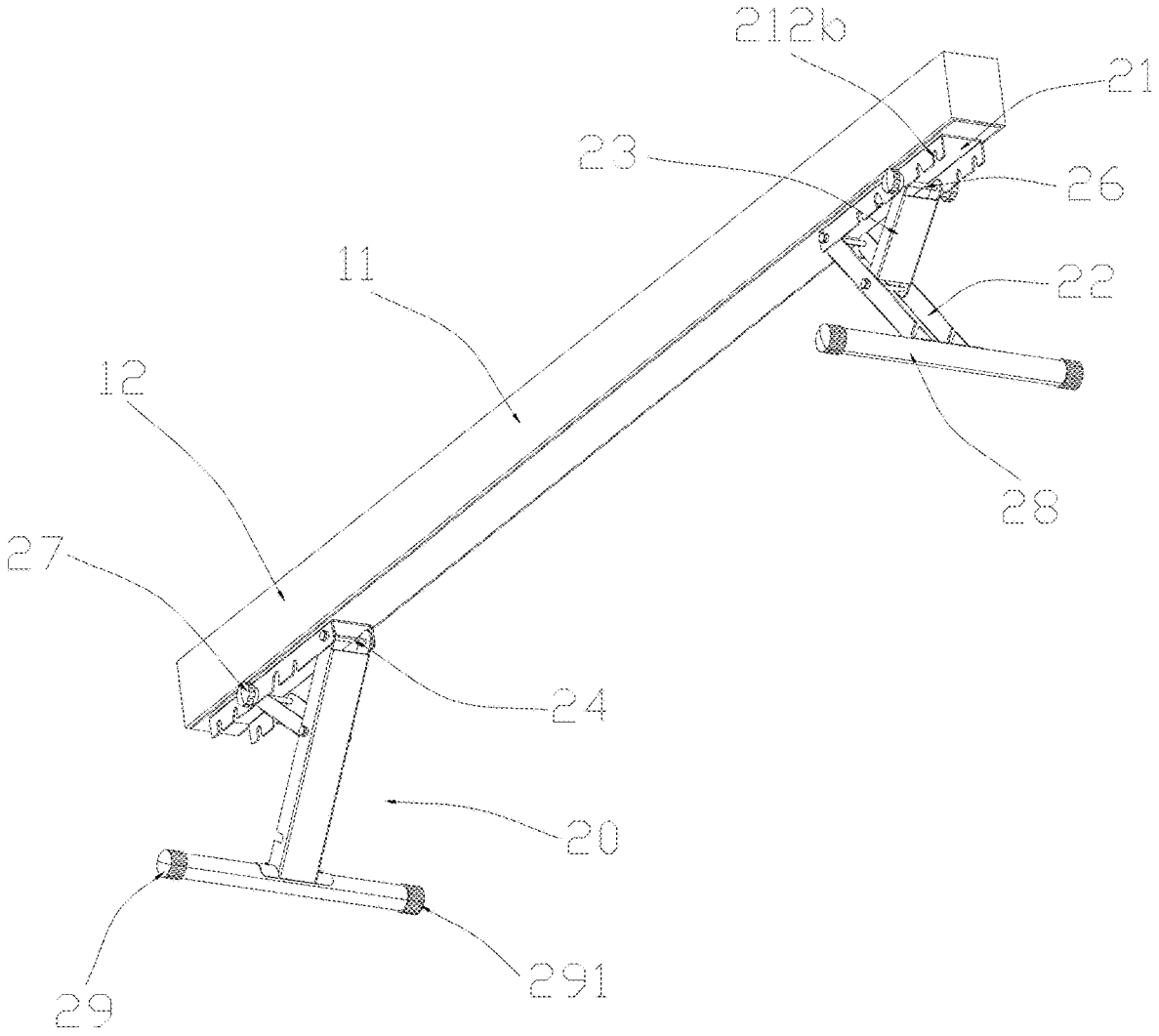
FIG. 2 is a schematic view of the structure of the present disclosure from another angle in the open state.
Figure 3:
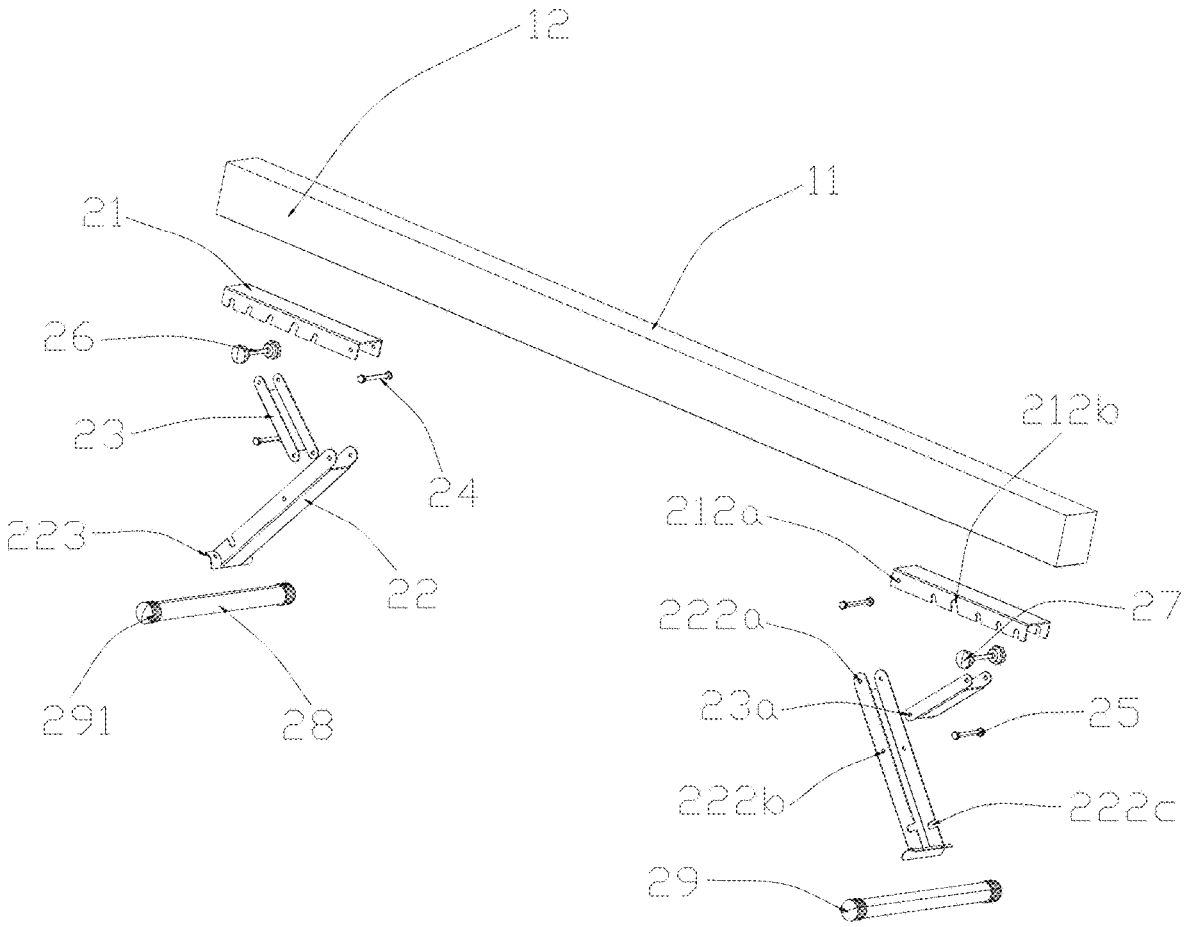
FIG. 3 is an exploded view of the structure of the present disclosure from one angle.
Figure 4:
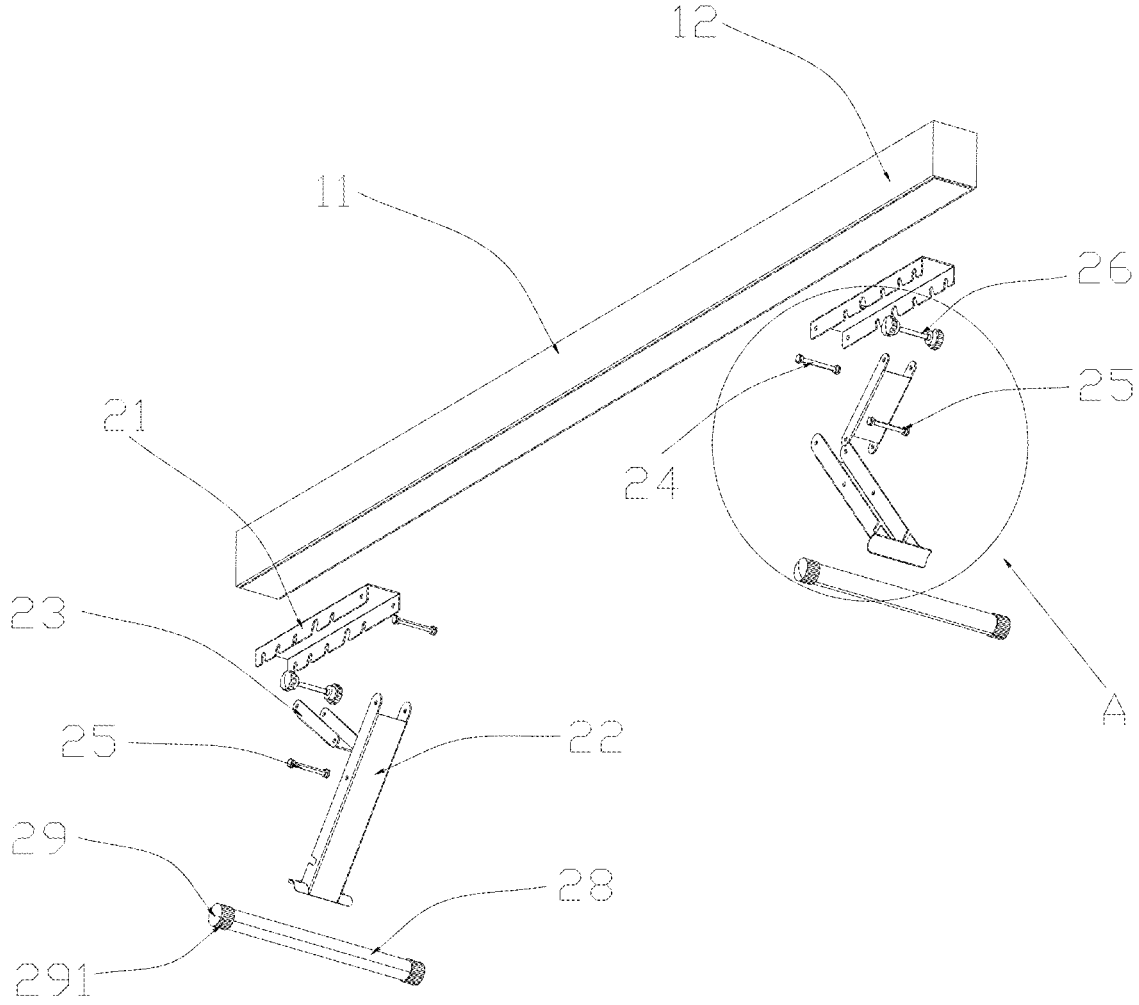
FIG. 4 is an exploded view of the structure of the present disclosure from another angle.
Figure 5:
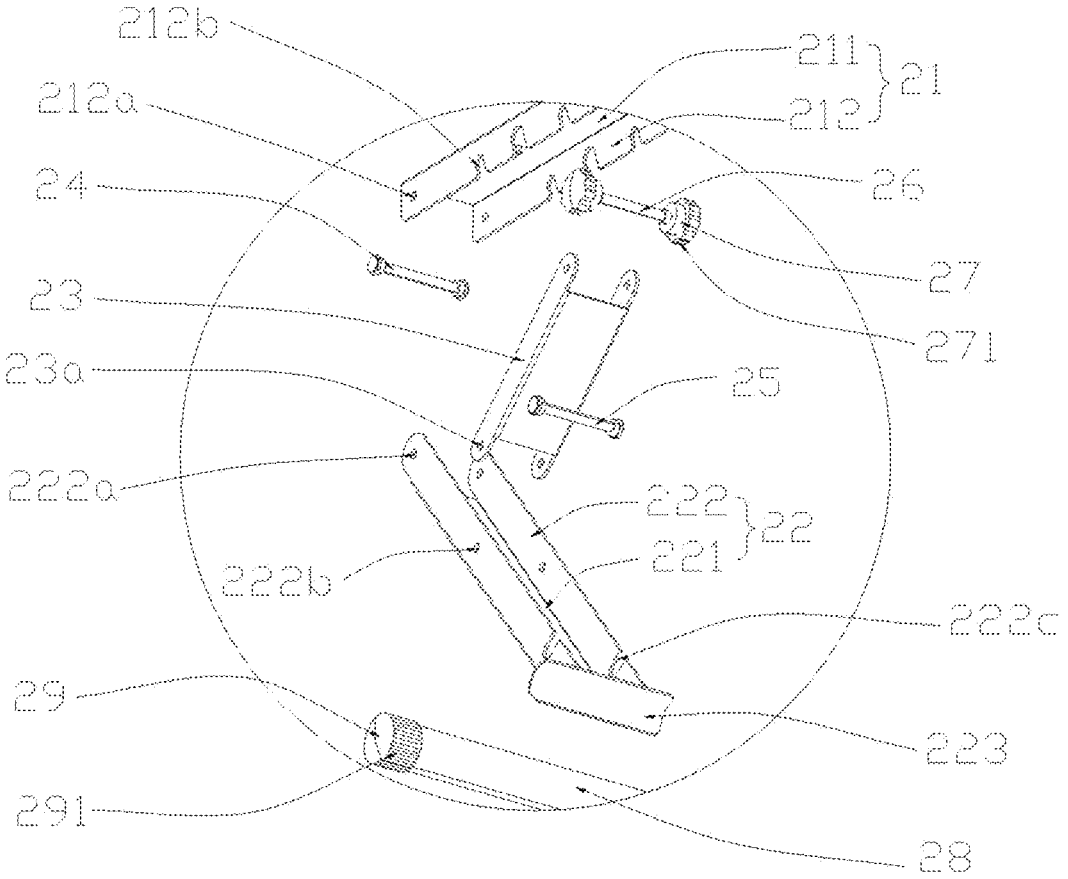
FIG. 5 is an enlarged view of circle A in FIG. 4.
Figure 6:
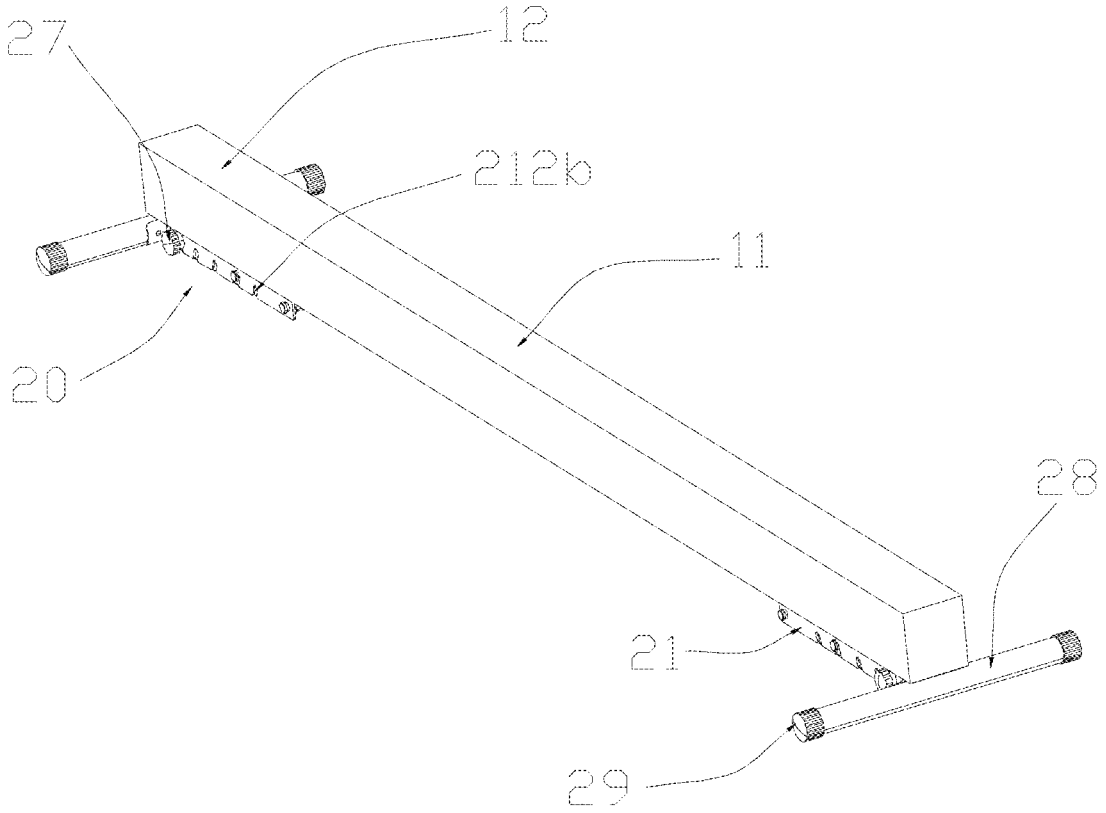
FIG. 6 is a schematic view of the structure of the present disclosure from one angle in a folding state.
Figure 7:
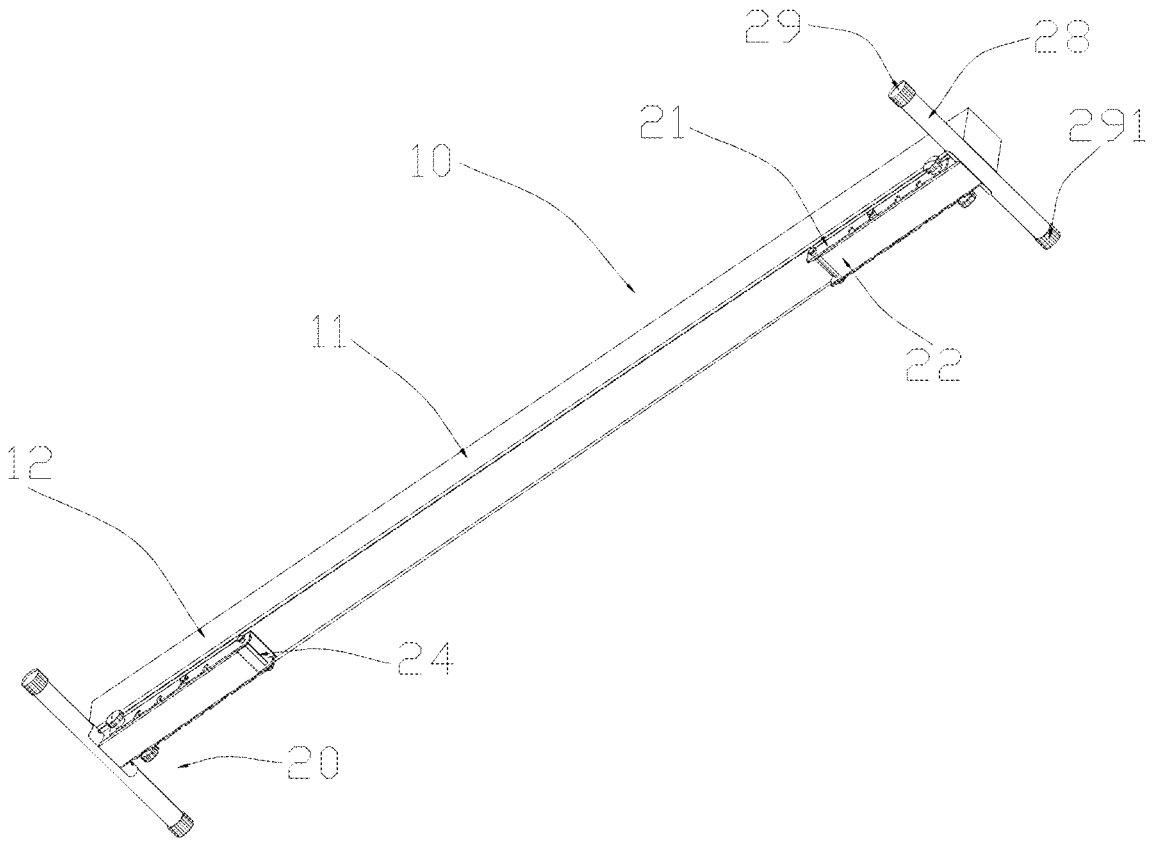
FIG. 7 is a schematic view of the structure of the present disclosure from another angle in the folding state.

Referring to FIG. 1 to FIG. 8, a balance beam includes: a main body 10, two support components 20, and a support component 20.

The main body 10 includes a middle part 11 and two connection parts 12 located on both sides;

The two support components 20 are respectively connected to the two connection parts 12;

The support component 20 includes a connector 21, a supporter 22, and an adjuster 23. The connector 21 is attached to the main body 10 and the connector 21 is provided with multiple connection positions at intervals. A connection end of the supporter 22 is rotatably connected to an end of the connector 21. The supporter 22 rotates between a folding state and an open state. A free end of the supporter 22 is configured to support on a support surface. A first end of the adjuster 23 is rotatably connected to the supporter 22, and a second end of the adjuster 23 is detachably connected to the connection position.

With the above structure, when in use, the supporter 22 is rotated to be inclined relative to the main body 10, then rotate the adjuster 23 and the second end the adjuster 23 is connected to the connection position, thus a triangular support structure is formed between the connector 21, the supporter 22, and the adjuster 23, which can stably support the main body 10. The connection position is located on the connector 21, and the connector 21 is located at a bottom of the connection part 12 of the main body 10, a significant part of the force exerted on the connector 21 is transferred to the main body 10, therefore shape and strength of the connector 21 with the connection positions can be ensured, and the supporter 22 and adjuster 23 is provided with no connection holes, resulting in higher structural integrity, making the overall product more robust and durable, less prone to deformation, and more stable.

In this embodiment, a first pivot shaft 24 is also provided. The connector 21 includes a first connection plate 211 and two second connection plates 212. The first connection plate 211 is connected to a bottom surface of the main body 10, and the two second connection plates 212 extend from two side edges of the first connection plate 211 away from the direction of the main body 10. A side of the two second connecting plates 212 near the middle part 11 is provided with a first pivot hole 212*a*. An end of the supporter 22 is provided with a second pivot hole 222*a*. The first pivot shaft 24 passes through the first pivot hole 212*a* and the second pivot hole 222*a*, the supporter 22 can be rotatably connected to the connector 21. With the above structure, the two second connection plates 212 are respectively connected to the side edges of the first connection plate 211. The first connection plate 211 and the two second connection plates 212 form an angle, effectively enhancing the strength of the connector 21. Additionally, the second connection plates 212 protrude from a surface of the first connection plate 211, and it is convenient to arrange the first pivot hole 212*a* and connection positions on the second connection plates 212, as well as to allow space for insertion of the first pivot shaft 24, making it user-friendly. The first pivot shaft 24 passing through the first pivot hole 212*a* and the second pivot hole 222*a* enables the supporter 22 to be rotatably connected to the connector 21, ensuring a stable connection.

In this embodiment, the supporter 22 includes a first support plate 221 and two second support plates 222. The two second support plates 222 extend from side edges of the first support plate 221 towards the main body 10. The second pivot holes 222*a* are located on the two second support plates 222. A distance between the two second support plates 222 is less than a distance between the two second connection plates 212, the two second support plates 222 are at least partially inserted between the two second connection plates 212. With the above structure, the two second support plates 222 are respectively connected to side edges of the first support plate 221. An angle is formed between the first support plate 221 and the two second support plates 222, effectively enhancing the strength of the supporter 22. The distance between the two second support plates 222 is less than the distance between the two second connection plates 212, the two second support plates 222 can be partially or completely inserted between the two second connection plates 212, and when the supporter 22 rotates relative to the connector 21, the second support plates 222 and the second connection plates 212 are staggered from each other, ensuring stability during the relative rotation. Additionally, when in the folding state, the second support plates 222 can be completely inserted between the second connection plates 212, reducing the overall volume of the product.

In this embodiment, a second pivot shaft 25 is also provided. A middle part of both second support plates 222 is provided with a third pivot hole 222*b*, and the end of the adjuster 23 is provided with a fourth pivot hole 23*a*. The second pivot shaft 25 passes through the third pivot hole 222*b* and the fourth pivot hole 23*a*, such that the first end of the adjuster 23 can be rotatably connected to the supporter 22. With the above structure, the second pivot shaft 25 passing through the third pivot hole 222*b* and the fourth pivot hole 23*a* enables the adjuster 23 to be rotatably connected to the supporter 22, enhancing the stability of the connection.

In this embodiment, a width of the adjuster 23 is less than a width between the two second support plates 222, the adjuster 23 can be at least partially inserted between the two second support plates 222. With the above structure, the width of the adjuster 23 is less than the width between the two second support plates 222, the adjuster 23 always remains between the two second support plates 222 when rotates relative to the supporter 22, ensuring stability during rotation. Additionally, in the folding state, the adjuster 23 is completely inserted between the two second support plates 222, and the two second support plates 222 can be completely inserted between the two second connection plates 212, further reducing the volume of the product.

In this embodiment, the connection position is a elongated shape slot 212*b* provided on the second connection plate 212. The second end of the adjuster 23 is provided with a contact rod 26, which can be detachably inserted into the slot 212*b*, such that a triangular support structure between the adjuster 23, at least a part of the connector 21 is formed, and a part of the supporter 22. With the above structure, when in use, the contact rod 26 can be detachably inserted into the elongated shape slot 212*b*, and the connection between the contact rod 26 and the slot 212*b* can be conveniently achieved. Additionally, under the gravity of the main body 10, the contact rod 26 continuously can fit snugly against an inner wall of the slot 212*b*, ensuring the stability of the product. To adjust the height of the product, the user only needs to move the contact rod 26 to different slots 212*b*, thereby adjusting angle between the adjuster 23, the connector 21, and the supporter 22, and consequently adjusting height of the product for case of use.

In this embodiment, the slot 212*b* is arranged at an incline, extending downwards and away from the middle part 11. With the above structure, the inclined arrangement of the slot 212*b* makes it easier for the contact rod 26 to be inserted along the slot 212*b* when the adjuster 23 rotates relative to the supporter 22, further facilitating user operation. Additionally, the contact rod 26 abuts against an inclined inner wall of the slot 212*b* and is essentially tangent to it, ensuring stable contact between the contact rod 26 and the inner wall of the slot 212*b*, preventing the contact rod 26 from sliding relative to the inner wall of the slot 212*b*, thereby enhancing the overall stability of the product.

In this embodiment, the contact rod 26 is also provided with fasteners 27 at both ends. The fasteners 27 are threadedly connected to ends of the contact rod 26. Twisting the fasteners 27 adjusts a distance between the fasteners 27, such that the fasteners 27 to abut against an outer surface of the second connection plate 212. With the above structure, users can adjust the distance between the two fasteners 27 by twisting them, thereby clamping them onto the outer surface of the second connection plate 212, further securing the contact rod 26 and enhancing the stability of the product.

In this embodiment, a support rod 28 located at a free end of the supporter 22 is further provided. An extension direction of the support rod 28 matches a direction of the first pivot shaft 24. With the above structure, the support rod 28 extends in an axial direction of the first pivot shaft 24, increasing surface area of the free end of the supporter 22, reducing the pressure between the product and the ground, preventing damage to the floor. Meanwhile, a length of the support rod 28 is greater than a width of the support rod 28, allowing for stable support on both sides of the balance beam and preventing the balance beam from tipping over to either side, further enhancing the product's stability.

In this embodiment, a protection cover 29 fitted over both ends of the support rod 28 is further provided. With the above structure, the protection cover 29 covers sharp edges and corners of both ends of the support rod 28, smoothing the product's edges. This reduces damage to support surface such as floor and also prevents sharp edges from scratching users, enhancing the product's safety and aesthetic appeal.

In this embodiment, the free end of the supporter 22 extends to both sides to form a mounting part 223, connected to the support rod 28, and a surface contour of the mounting part 223 matches a surface contour of the support rod 28. With the above structure, the mounting part 223 extends outward from both sides of the free end of the supporter 22, which facilitates connection of the support rod 28 to the supporter 22 and also increases contact area between the support rod 28 and the supporter 22, and reduces the pressure exerted by the free end of the supporter 22 on a surface of the support rod 28, further enhancing the product's stability and strength.

In this embodiment, when the supporter 22 is rotated to the folding state, the second pivot shaft 25 is inserted into one of the slots 212*b* located in a middle, and the contact rod 26 is inserted into one of the slots 212*b* located at an edge. With the above structure, the contact rod 26 is inserted into a slot 212*b* at the edge, meanwhile, the adjuster 23 is completely inserted between the two second support plates 222, and the two second support plates 222 can be completely inserted between the two second connection plates 212, further reducing the volume of the product, and the contact rod 26 also provides a securing function that prevents the connector 21, supporter 22, and adjuster 23 together from detaching.

In this embodiment, the second support plates 222 is provided with a receiving slot 222*c*. When the supporter 22 is rotated to the folding state, the receiving slot 222*c* corresponds to the slot 212*b*, and the contact rod 26 is inserted into the receiving slot 222*c*. With the above structure, the receiving slot 222*c* allows an insertion of the contact rod 26, then enabling the adjuster 23 to be completely inserted between the two second support plates 222 and the two second support plates 222 can be completely inserted between the two second connection plates 212, making the product's supporter 22 more stable when in the folding state.

In this embodiment, a length of the supporter 22 is greater than a length of the second connection plate 212. When the supporter 22 is rotated to the folding state, the support rod 28 is located on a side of the second connection plate 212 far from the middle part 11. With the above structure, the length of the supporter 22 is greater than the length of the second connection plate 212, when the supporter 22 is rotated to the folding state, the adjuster 23 is completely inserted between the two second support plates 222, and the two second support plates 222 can be completely inserted between the two second connection plates 212. The support rod 28 is located outside the second connection plate 212, meanwhile, the connector 21, supporter 22, adjuster 23, and support rod 28 are all in same plane, further reducing the volume of the product.

In this embodiment, the fasteners 27 are provided with a plurality of protrusions 271 at intervals along circumferential surface. With the above structure, users can grip the protrusions 271, facilitating twisting of the fasteners 27 and making the product more user-friendly.

In this embodiment, an outer surface of the protection cover 29 is provided with frictional patterns 291. With the above structure, frictional patterns 291 can increase the coefficient of friction on the outer surface of protection cover 29, thereby enhancing the grip between the protection cover 29 and the support surface such as floor, ensuring the product is more stably placed on the support surface such as the floor.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A balance beam, comprising:

a main body comprising a middle part and two connection parts located on opposing sides of the main body;

two support components respectively connected to the two connection parts;

each support component comprising a connector, a supporter, and an adjuster, wherein the connector is connected to the main body and the connector is provided with multiple connection positions at intervals, a connection end of the supporter is rotatably connected to an end of the connector, the supporter rotates between a folding state and an open state, a free end of the supporter is configured to support on a support surface, a first end of the adjuster is rotatably connected to the supporter, and a second end of the adjuster is detachably connected to one of the multiple connection positions.

2. The balance beam according to claim 1, further comprising a first pivot, the connector comprises a first connection plate and two second connection plates, the first connection plate is connected to a bottom surface of the main body, and the two second connection plates extend from opposing side edges of the first connection plate in a direction away from the main body, a side of the two second connection plates near the middle part is provided with a first pivot hole, the connection end of the supporter is provided with a second pivot hole, and the first pivot passes through the first pivot hole and the second pivot hole, allowing the supporter to be rotatably connected to the connector.

3. The balance beam according to claim 2, the supporter comprising a first support plate and two second support plates, the two second support plates extend from opposing side edges of the first support plate in a direction towards the main body, the second pivot hole is arranged in the two second support plates, a distance between the two second support plates is less than a distance between the two second connection plates, and the second support plate is at least partially inserted between the two second connection plates.

4. The balance beam according to claim 3, further comprising a second pivot, wherein middle parts of both of the two second support plates are provided with a third pivot hole, and the first end of the adjuster is provided with a fourth pivot hole, and the second pivot passes through the third pivot hole and the fourth pivot hole, allowing the first end of the adjuster to be rotatably connected to the supporter.

5. The balance beam according to claim 4, wherein a width of the adjuster is smaller than a width between the two second support plates, and the adjuster is at least partially inserted between the two second support plates.

6. The balance beam according to claim 4, wherein each of the multiple connection positions is an elongated shape slot arranged on the second connection plate, the second end of the adjuster is provided with a contact rod which can be detachably inserted into the elongated shape slot, such that a triangular support structure between the adjuster, at least a part of the connector, and a part of the supporter is formed.

7. The balance beam according to claim 6, wherein the elongated shape slot is arranged at an incline, extending and inclining downwards from near the middle part in a direction away from the middle part.

8. The balance beam according to claim 6, wherein the contact rod is provided with fasteners at opposing ends thereof, the two fasteners are threadedly connected to the opposing ends of the contact rod, and twisting the two fasteners adjusts a distance between the two fasteners, allowing the two fasteners to abut against an outer surface of the second connection plate.

9. The balance beam according to claim 8, wherein each fastener is provided with a plurality of protrusions at intervals along a circumferential surface thereof.

10. The balance beam according to claim 6, wherein when the supporter is rotated to the folding state, the second pivot is inserted into the elongated shape slot located in a middle of the second connection plate, and the contact rod is inserted into the elongated shape slot located at an edge of the second connection plate.

11. The balance beam according to claim 10, wherein the second support plate is provided with a receiving slot, when the supporter rotates to the folding state, the receiving slot corresponds to the elongated shape slot located at the edge of the second connection plate, and the contact rod is inserted into the receiving slot.

12. The balance beam according to claim 2, further comprising a support rod arranged at the free end of the supporter, wherein an extension direction of the support rod matches a direction of the first pivot.

13. The balance beam according to claim 12, further comprising a protection cover fitted over opposing ends of the support rod.

14. The balance beam according to claim 13, wherein an outer surface of the protection cover is provided with frictional patterns.

15. The balance beam according to claim 12, wherein the free end of the supporter extends to opposing ends thereof to form a mounting part, the mounting part is connected to the support rod, and a surface contour of the mounting part matches a surface contour of the support rod.

16. The balance beam according to claim 12, wherein a length of the supporter is greater than a length of the second connection plate, when the supporter rotates to the folding state, the support rod is located on a side of the second connection plate that is external and away from the middle part.

* * * * *